US005158446A

United States Patent [19]

Hall

[11] Patent Number: 5,158,446

[45] Date of Patent: Oct. 27, 1992

[54] COMBINATION PRESSURE AND TEMPERATURE LIMIT CONTROL FOR A FUEL-FIRED, FORCED DRAFT HEATING APPLIANCE COMBUSTION PRODUCT EXHAUST SYSTEM

[75] Inventor: Jacob H. Hall, Montgomery, Ala.

[73] Assignee: Rheem Manufacturing Company, New York, N.Y.

[21] Appl. No.: 860,055

[22] Filed: Mar. 30, 1992

[51] Int. Cl.[5] ..... F23N 3/00

[52] U.S. Cl. ..... 431/20; 431/18; 431/19; 126/351; 122/13.1

[58] Field of Search ..... 431/18, 19, 20; 126/312, 351, 374, 116 A; 110/162; 236/1 A, 1 H, 15 C; 122/13.1, 14, 17

[56] References Cited

U.S. PATENT DOCUMENTS

| | | | |
|---|---|---|---|
| 2,704,571 | 3/1955 | Reichelderfer | 431/19 X |
| 2,955,945 | 10/1960 | Hunter | 415/47 X |
| 3,042,769 | 7/1962 | Campbell | 200/83 |
| 3,403,962 | 10/1968 | Suffron et al. | 431/20 |
| 3,469,569 | 9/1969 | Brockbank | 126/116 |
| 4,044,950 | 8/1977 | Engeling et al. | 237/55 |
| 4,204,832 | 5/1980 | Miller | 431/20 |
| 4,273,526 | 6/1981 | Perrelli | 431/19 X |
| 4,403,942 | 9/1983 | Copenhaver | 431/24 |
| 4,613,297 | 9/1986 | Zanias et al. | 431/16 |
| 4,682,579 | 7/1987 | Bigham | 126/116 A X |
| 4,856,982 | 8/1989 | Olson | 431/20 |
| 4,867,106 | 9/1989 | Staats | 110/162 X |
| 4,951,651 | 8/1990 | Shellenberger | 126/116 R |

*Primary Examiner*—Carl D. Price

*Attorney, Agent, or Firm*—Konneker & Bush

[57] ABSTRACT

A fuel-fired, forced draft heating appliance includes a draft inducer fan having an inlet connected to a vent hood, an outlet connectable to a vent pipe, and an interior housing region in which a negative pressure is generated during normal appliance operation. The vent hood receives hot combustion gases generated by the appliance, and has an inlet for receiving ambient dilution air that mixes with and cools the combustion gases entering the hood and subsequently discharged into the vent pipe by the fan. A combination pressure and temperature limit control is used to sense the presence of an obstruction in either the vent pipe or the vent hood inlet and responsively shut down the appliance. The control includes a vacuum switch external to the fan, a bimetallic disc-type temperature sensor disposed within the negative pressure fan region, and a conduit interconnecting the switch and the temperature sensor. During normal appliance operation an ambient air flow is drawn into the fan housing sequentially through the vacuum switch, the conduit and the temperature sensor. An obstruction in the vent pipe sufficient to reduce this air flow below a predetermined level causes the vacuum switch to responsively shut down the appliance. An undesirably high temperature within the fan, arising for example due to an obstruction in the vent hood inlet, causes the temperature sensor disc to block air flow through the conduit, thereby also causing the vacuum switch to responsively shut down the appliance.

16 Claims, 1 Drawing Sheet

COMBINATION PRESSURE AND TEMPERATURE LIMIT CONTROL FOR A FUEL-FIRED, FORCED DRAFT HEATING APPLIANCE COMBUSTION PRODUCT EXHAUST SYSTEM

BACKGROUND OF THE INVENTION

The present invention relates generally to heating devices, and more particularly relates to control apparatus for sensing an obstruction in the combustion product exhaust portion of a fuel-fired heating appliance, such as a water heater, boiler, furnace or the like, and responsively shutting down the appliance.

Many fuel-fired heating appliances of the types mentioned above are of the forced draft variety in which a draft inducer fan is utilized to force the hot combustion gases generated by the appliance, during operation thereof, into a suitable vent pipe for discharge remote from the appliance. A common method of connecting the draft inducer fan to the appliance is to communicate the fan inlet with the outlet of a draft hood structure adapted to receive the hot combustion gases generated by the appliance and having an inlet for receiving ambient dilution air. As the draft inducer fan draws hot combustion gases through the hood it also draws ambient air into the hood. The ambient dilution air entering the hood mixes with the combustion gases in order to substantially lower their temperature before they are drawn into the draft inducer fan inlet and ultimately discharged from the fan into and through the vent pipe. This cooling of the combustion gases is particularly important in instances where a plastic material (such as, for example, PVC plastic) is used to form the vent pipe.

It is common practice to provide a heating appliance combustion gas exhaust system of this type with a safety control for detecting an obstruction in the vent pipe, which interferes with the designed-for remote discharge of the combustion gases, and responsively shutting down the appliance s that the vent pipe obstruction can be located and removed. This appliance shutdown upon a sensed vent pipe restriction serves to prevent undesirable combustion gas discharge, by reverse flow through the vent hood, immediately adjacent the appliance.

A conventional method of effecting this appliance shutdown in the event of a significant vent pipe flow restriction is to monitor the draft inducer fan scroll vacuum using a vacuum switch to prove fan operation. This is typically accomplished by connecting one end of a flexible tube or other conduit means to the outlet of the vacuum switch, and the opposite end of the tube to the fan inlet section by means of a hollow probe extending inwardly through the fan housing wall and having an open inner end positioned outwardly adjacent the fan's centrifugal impeller.

During normal operation of the combustion product exhaust system, the vacuum in the fan scroll draws a flow of ambient air into the scroll sequentially through the vacuum switch, the flexible tube and the hollow probe. This vacuum-induced inward air flow is sensed by the switch. As long as the air flow is maintained at a predetermined minimum level, the switch permits continued operation of the appliance. However, in the event that the air flow through the switch falls below such minimum level, occasioned for example by an obstruction in the vent pipe, the switch automatically shuts down the appliance.

While this vacuum switch method of sensing and responding to vent pipe obstruction has proven to be an effective and relatively inexpensive approach to monitoring vent pipe blockage, as conventionally practiced it is subject to a variety of well known limitations. For example, it is not a reliable indicator of an obstruction in the vent hood dilution air inlet. Given such obstruction, it is still possible for a negative air pressure to exist in the fan scroll of sufficient magnitude that the vacuum switch permits continued operation of the appliance. This negative pressure, though, is being achieved in this circumstance with a reduction in the intended ratio of cooling dilution air to hot combustion gases forced into the vent pipe by the draft inducer fan. The temperature of the gases discharged into vent pipe may thus be undesirably high and can damage vent pipe material.

In view of the foregoing it can be seen that it would be desirable to provide improved sensing and control apparatus that would reliably sense an obstruction in either the vent pipe or vent hood inlet opening portion of a forced draft, fuel-fired heating appliance and responsively shut down the appliance. It is accordingly an object of the present invention to provide such improved sensing and control apparatus.

SUMMARY OF THE INVENTION

In carrying out principles of the present invention, in accordance with a preferred embodiment thereof, a forced draft, fuel-fired heating appliance (representatively in the form of a water heater) is provided with a unique combination pressure and temperature limit control associated with the draft inducer fan portion of the appliance. The limit control is operative to sense an obstruction in either the vent pipe or vent hood inlet portion of the appliance and responsively shut down the appliance to prevent undesirable discharge of combustion gases adjacent the appliance and/or the sustained discharge of insufficiently cooled combustion gases into the appliance vent pipe.

From a broad perspective, the control structure of the present invention comprises (1) pressure sensing means for permitting a flow of ambient air to be drawn therethrough into a negative pressure region of the draft inducer fan housing during fan operation, sensing the magnitude of the flow of ambient air, and precluding operation of the appliance when the air flow magnitude falls below a predetermined level; and (2) temperature sensing means for sensing the temperature within the draft inducer fan and essentially precluding the flow of ambient air through the pressure sensing means in response to a sensed temperature exceeding a predetermined maximum temperature.

In a preferred embodiment thereof, the combination pressure and temperature limit control includes a vacuum switch positioned externally of the draft inducer fan and having an outlet connected to one end of a flexible conduit the other end of which is connected to a hollow housing portion of a temperature sensor disposed within the aforementioned negative pressure region of the fan housing. An air flow passage extends sequentially through the vacuum switch, the flexible conduit, and the temperature sensor housing into the fan interior.

During normal operation of the appliance, a flow of ambient air is drawn into the fan interior via this air flow passage. In the event that the ambient air inflow rate through the passage falls below a predetermined level, occasioned for example by an obstruction in the vent pipe, the vacuum switch automatically senses the flow rate reduction and responsively shuts down the appliance.

A temperature sensitive, bimetallic snap-action disc is positioned within the temperature sensor housing for temperature driven flexure between a first position in which the disc permits ambient air flow from the inner end of the flexible conduit into the fan interior through the temperature sensor housing, and a second position in which the disc blocks the inflow of ambient air into the fan housing from the tube through the temperature sensor housing. As long as the temperature within the draft inducer fan housing remains below a predetermined level the bimetallic disc remains is its first position.

However, in the event that the internal fan temperature rises above the predetermined level thereof, occasioned for example by an obstruction in the vent hood inlet that reduces cooling dilution air inflow therethrough, the disc automatically flexes to its second position. This blocks inward air flow through the vacuum switch, thereby causing it to responsively shut down the appliance. Accordingly, due to the in-series connection of the temperature sensor and vacuum switch, the switch is advantageously made operative to shut down the appliance in response to an obstruction in either the vent pipe or the vent hood inlet. No additional control wiring is required, and the addition of the temperature sensor does not substantially increase the overall cost of the appliance.

The combination pressure and temperature limit control of the present invention is particularly well suited for use in conjunction with the combustion products exhaust system of forced draft, fuel-fired heating appliances. However, as will be readily be appreciated by those skilled in this art, the combination control may also be advantageously utilized in conjunction with other types of fan-driven gas moving systems to shut down the fan in the event of either a fan outlet passage obstruction or an undesirably inlet temperature of gas being drawn into the fan housing during fan operation.

DETAILED DESCRIPTION

Figure 1:
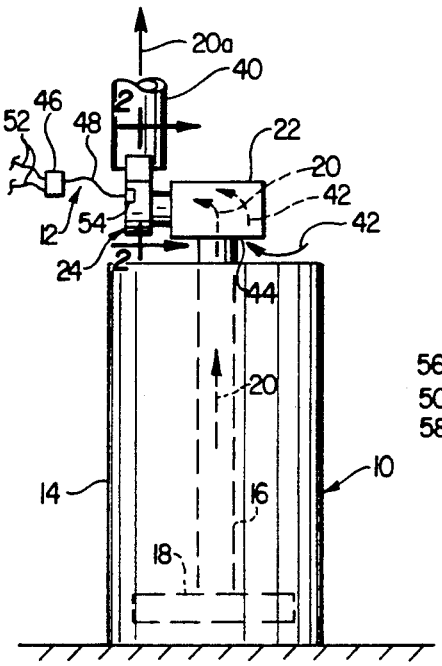
FIG. 1 is a schematic front elevational view of a fuel-fired heating appliance, representatively in the form of a water heater, that incorporates in its combustion product exhaust system a unique combination pressure and temperature limit control embodying principles of the present invention.

Schematically illustrated in FIG. 1 is a forced draft, fuel-fired heating appliance, representatively in the form of a water heater 10, which incorporates in its combustion products exhaust system a unique combination pressure and temperature limit control structure 12 that embodies principles of the present invention.

The representative water heater 10 includes a water storage tank 14 interiorly through which a water heating flue 16 upwardly passes. During firing of the water heater 10, a burner assembly 18 generates hot combustion gases 20 that pass upwardly through the flue 16, into a vent hood 22 mounted atop the tank 14, by the operation of a centrifugal draft inducer fan 24. As the hot combustion gases 20 upwardly traverse the flue 16, combustion heat from the gases is transferred to pressurized water disposed in the tank. The water heated in this manner may be subsequently discharged from the tank through a hot water supply pipe (not shown) operatively connected to the tank.

Figure 2:
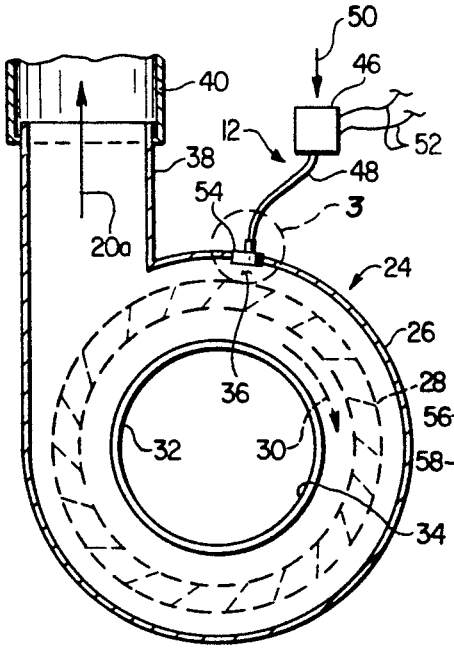
FIG. 2 is an enlarged scale, partially phantomed and somewhat simplified cross-sectional view taken along line 2—2 of FIG. 1 through a draft inducer fan portion of the appliance and schematically illustrating the components of the pressure and temperature limit control.

Referring additionally now to FIG. 2, the draft inducer fan 24 has a housing with a scrolled inlet portion 26 within which a centrifugal impeller 28 is disposed for driven rotation, in the direction indicated by arrow 30, by an appropriate fan motor (not shown). Fan housing portion 26 has an inlet opening 32 that is connected to the vent hood 22. During driven rotation of the impeller 28, a negative pressure region 36 is induced within the interior of the fan housing inlet portion 26 radially outwardly of the rotating impeller 28. The fan housing also has a discharge section 38 that is connected as shown in FIG. 2 to the inlet end of a vent pipe 40.

As stated previously, during firing of the water heater 10 and operation of the draft inducer fan 24 the hot combustion gases 20 generated by the burner assembly 18 pass upwardly through the submerged flue 16 into the vent hood 22. Operation of the draft inducer fan 24 also draws a flow of ambient dilution air 42 (see FIG. 1) into the interior of the vent hood 22 through vent hood inlet openings 44. The dilution air 42 entering the vent hood 22 mixes with and cools the hot combustion gases 20 entering the vent hood, the cooled combustion gases 20*a* entering the fan inlet opening 32 and being forced into the vent pipe 40, via the fan housing discharge section 38, for subsequent discharge to an outside area remote from the water heater 10.

As schematically depicted in FIGS. 1 and 2, the combination pressure and temperature limit control structure 12 includes a conventional vacuum pressure switch 46 disposed externally of the fan housing and having an outlet to which the inner end of a flexible conduit 48 is connected. In the conventional use of the switch 46 in this setting, a hollow probe (not shown) is connected to the outer end of the conduit 48 and communicated with the negative pressure interior region 36 of the fan housing. During normal operation of the draft inducer fan 24 (i.e., in the absence of an appreciable obstruction in the vent pipe 40) a flow of ambient air 50 (FIG. 2) is drawn into the negative pressure region 36 of the fan housing sequentially via the interiors of the vacuum switch 46, the flexible conduit 48, and the aforementioned hollow probe.

The vacuum switch 46 is conventionally operative to sense the rate of air flow drawn therethrough by the induced fan housing vacuum in interior region 36. In the event that the sensed air flow rate through switch 46 falls below a predetermined minimum level, as might be occasioned for example by an obstruction in the vent pipe 40 that markedly reduces the induced vacuum in interior fan housing region 36, the switch 46 automatically terminates the firing of the water heater. Representatively, this appliance shutoff in response to a sensed blockage of vent pipe 40 is effected by an electrical shutoff signal transmitted from the switch 46 to the water heater control circuitry via electrical switch leads 52. The automatic appliance shutoff permits the sensed vent pipe obstruction (or other combustion product exhaust system malfunction) to be appropriately attended to and remedied to prevent a sustained outflow of combustion gases through the vent hood inlet 44 and/or overheating of the draft inducer fan 24.

When conventionally connected to the draft inducer fan housing as described above, the vacuum switch 46 functions quite adequately to detect an obstruction in the vent pipe 40 and responsively shut down the water heater. However, in its conventional application the switch can be "fooled" by another possible combustion products exhaust system malfunction—namely, an obstruction of the vent hood inlet openings 44 that materially reduces the inflow therethrough of ambient dilution air 42, thereby substantially increasing the temperature of combustion gases drawn into the draft inducer fan 24 and discharged therefrom into the vent pipe 40.

Specifically, if the vent hood inlet openings 44 (but not the vent pipe 40) are obstructed, the gas flow rate through the draft inducer fan, and thus the induced vacuum within the interior fan housing region 36, may remain at a level high enough to prevent the vacuum switch 46 from detecting the problem and responsively shutting down the water heater. The resulting sustained high temperature combustion gas flow through the fan 24 and plastic vent pipe 40 can result in damage to one or both of these exhaust system components.

In accordance with an important aspect of the present invention this potential problem is substantially eliminated by the in-series connection with the vacuum switch 46 of a temperature sensor 54 positioned at the outer end of the flexible conduit 48. As will be seen, this series addition of the temperature sensor permits the same flow sensing action of the conventional vacuum switch 46 to shut down the water heater in response to the presence of an obstruction in either the vent pipe 40 or the vent hood inlet 44 during water heater operation. Importantly, this expanded control capability of the vacuum switch is achieved without the need for any additional wiring between the switch and the water heater control circuitry.

Figure 3A:
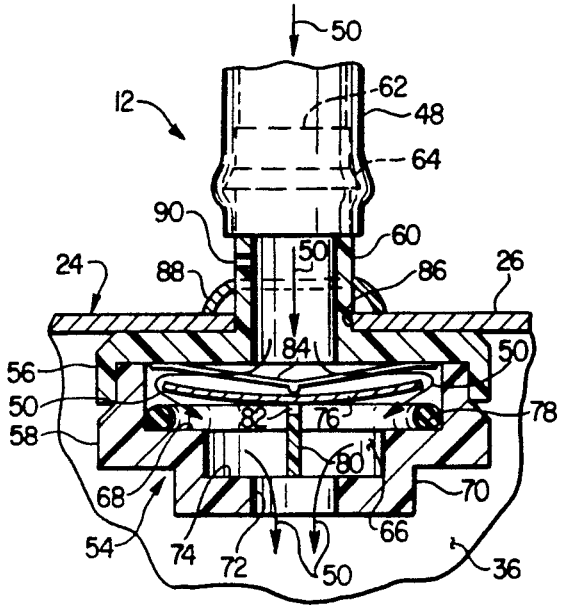
FIGS. 3A and 3B are cross-sectional enlargements of the circled area "3" in FIG. 2 and respectively illustrate a bimetallic temperature sensing disc portion of the pressure and temperature limit control in its normal and blocking positions.
Figure 3B:
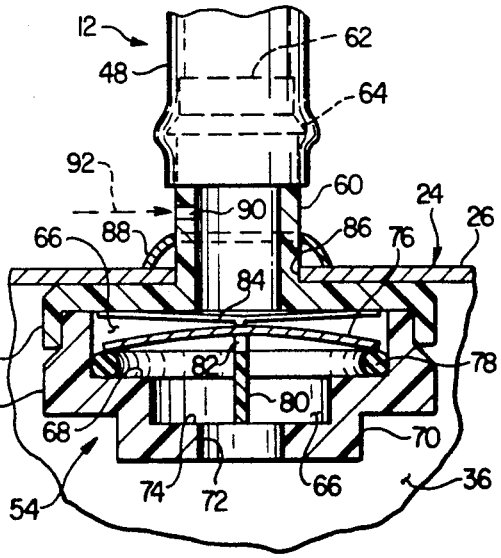

Referring now to FIGS. 3A and 3B, the temperature sensor 54 is generally similar in construction and operation to the model 26V snap action flow valve manufactured by Therm-O-Disc Incorporated, Mansfield, Oh., and includes a generally cylindrical hollow plastic housing formed from telescoped upper and lower sections 56 and 58. Upper housing section 56 is centrally provided with an upwardly projecting inlet tube portion 60 that has an open upper end 62, an annular external hose connection barb 64, and an interior that communicates with a chamber 66 defined within the sensor housing.

The lower housing section 58 is configured to define an annular, upwardly facing vertically intermediate ledge 68 within the sensor housing interior, and has a hollow cylindrical depending central portion 70. Portion 70 has a reduced diameter circular outlet opening 72 formed centrally through its bottom end, and forms an annular, upwardly facing ledge 74 concentric with and disposed beneath the ledge 68 within the sensor housing interior.

Coaxially disposed within the radially enlarged portion of chamber 66 above ledge 68 is a temperature sensitive, snap-action bimetallic disc 76 having a peripheral edge portion that overlies a resilient 0-ring seal member 78 resting on the periphery of ledge 68. Disc 76 is supported within the radially enlarged portion of chamber 66 above ledge 68 by a vertically oriented plastic support plate 80 disposed within the sensor housing chamber 66. Support plate 80 extends centrally across the outlet opening 72 and has opposite bottom side edge portions that downwardly bear against radially opposite portions of the ledge 74. A central, upwardly projecting tab 82 on the support plate 80 is centrally secured to the underside of the bimetallic disc 76. A downward resilient retaining force is exerted on the disc 76 by an elongated leaf spring member 84. A central portion of spring 84 bears against a central upper side portion of the disc, and the outer ends of the spring upwardly bear against the underside of housing portion 56 as shown in FIGS. 3A and 3B.

The temperature sensor 54 is installed within the draft inducer fan housing inlet portion 26, in the negative interior pressure region 36 thereof, by passing the sensor inlet tube 60 outwardly through an appropriately sized circular opening 86 formed through the fan housing, and then passing an annular friction clip member 88 downwardly over the outwardly projecting portion of inlet tube 60 to lock the temperature sensor 54 to the fan housing. The outer end of the flexible vacuum switch conduit 48 is then forced downwardly over the barbed upper end portion of the inlet tube 60. For purposes later described, a small vacuum relief opening 90 is formed through the side wall of the inlet tube 60 between the clip member 80 and the lower end of the flexible conduit as shown in FIGS. 3A and 3B.

Still referring to FIGS. 3A and 3B, as long as the bimetallic disc 76 is exposed to a temperature below a predetermined actuation temperature (for example, the maximum temperature to be permitted to occur within the fan housing during driven rotation of the fan impeller), the disc remains in its normal, upwardly nutated position shown in FIG. 3A. In such normal position thereof, the disc 76 permits a flow of ambient air 50 downwardly through its housing into the negative pressure region 36 during driven rotation of the fan impeller.

Specifically, during normal operation of the water heater combustion products exhaust system, the vacuum induced in the interior fan housing region 36 draws a flow of ambient air 50 into the fan housing sequentially through the vacuum switch 46; the flexible conduit 48; the inlet tube 60; into the upper side of the temperature sensor housing chamber 66; along the top side of the upwardly nutated disc 76 (see FIG. 3A); downwardly through the illustrated annular gap between the disc periphery and the 0-ring seal 78; downwardly through the reduced diameter lower portion of housing chamber 66; and then outwardly through the housing outlet opening 72.

In the event that the vent pipe 40 becomes sufficiently obstructed to reduce the inflow of ambient air 50 through the temperature sensor housing to a level below the air flow set point of the vacuum switch 46, the switch functions in its normal manner to responsively shut down the water heater.

Additionally, in the event that an obstruction occurs in the vent hood inlet opening 44 and causes the interior fan housing temperature to exceed the temperature set point of the bimetallic disc 76, the disc downwardly nutates, in a snap-action fashion, from its FIG. 3A "open" position to its FIG. 3B "closed" position. With the disc in its closed position, the periphery of the disc downwardly engages and compresses the 0-ring seal member 78 to thereby seal off the portion of the housing chamber 66 above the disc from the portion of the housing chamber 66 below the disc. This blocks the downward air flow through the temperature sensor housing, thereby terminating the inward flow of ambient air 50 through the vacuum switch 46.

The cessation of air flow through vacuum switch 46 causes it to responsively shut down the water heater 10. Importantly, this vacuum switch-created shutdown of the water occurs even in the event that the vacuum in the interior fan housing region 36 is sufficient to otherwise permit the vacuum switch 46 (i.e., in the absence of the uniquely series-connected temperature sensor 54) to allow an undesirable continued operation of the water heater 10.

Thus, the incorporation of the temperature sensor 54 in the control structure 12 causes the conventional vacuum switch 46 to be both temperature and pressure sensitive, and enables it to sense an obstruction in either the vent pipe 40 or the vent hood inlet 4 (or another exhaust system malfunction) and responsively shut down the water heater. The provision of the small opening 90 in the side of the inlet tube 60 permits a residual vacuum trapped in the flexible conduit 48 when the disc 76 snaps shut to be dissipated by the inflow of ambient air 92 through opening 90 (see FIG. 3B). This advantageously permits the internal diaphragm portion of the vacuum switch 46 to reset itself prior to the disc 76 snapping back to its normally open position.

While the combination pressure and temperature limit control structure 12 of the present invention has been representatively illustrated as being used in conjunction with the combustion products exhaust system of a fuel-fired water heater, it will be readily appreciated that it could also be utilized to advantage with other types of forced draft, fuel-fired heating appliances such as, for example, boilers and furnaces. As will also be appreciated by those skilled in this art, the structure 12 could also be used on various types of fans to sense fan outlet obstructions, and/or undesirably high internal fan housing temperatures, and responsively shut down the fan.

The foregoing detailed description is to be clearly understood as being given by way of illustration and example only, the spirit and scope of the present invention being limited solely by the appended claims.

What is claimed is:

1. Gas handling apparatus comprising:

a fan having a housing with an inlet for receiving a flow of gas, and an outlet for discharging the received gas, said housing, during operation of said fan, having a negative pressure interior region;

first passage defining means, connected to said inlet, through which the gas may be drawn into said fan during operation thereof;

second passage defining means, connected to said outlet, into which the gas may be discharged from said fan during operation thereof; and control means for sensing a gas flow obstruction associated with either of said first and second passage defining means during operation of said fan and responsively shutting down said fan, said control means including:

pressure sensing means for permitting a flow of ambient air to be drawn into said negative pressure interior region of said housing during operation of said fan, sensing the magnitude of said flow of ambient air, and precluding operation of said fan when said magnitude falls below a predetermined level, and temperature sensing means for sensing the temperature within said housing and essentially precluding the flow of ambient air through said pressure sensing means in response to a sensed temperature exceeding a predetermined temperature.

2. The gas handling apparatus of claim 1 wherein said temperature sensing means include:

a sensor housing having an inlet and an outlet, said sensor housing being connected to said pressure sensing means in a manner permitting said flow of ambient air to pass therethrough from said sensor inlet to said sensor outlet, and a bimetallic element disposed within said sensor housing and operative to block air flow through said sensor housing upon exposure of said bimetallic element to a temperature exceeding said predetermined temperature.

3. The gas handling apparatus of claim 2 wherein:

said pressure sensing means include a vacuum pressure switch having an air outlet communicated with said sensor housing inlet.

4. A forced draft, fuel-fired heating appliance comprising:

heating means operative to generate combustion gas during use of said appliance;

exhaust means for exhausting the combustion gas from said appliance to a location remote from said appliance, said exhaust means including a draft inducer fan having a housing with an inlet for receiving the combustion gas, and an outlet for discharging the combustion gas, said housing, during fan operation, having a negative pressure interior region; and control means for shutting said appliance down in response to a predetermined pressure increase within said negative pressure interior region of said fan housing, or to the presence of an undesirably high temperature within said fan housing, said control means including:

pressure sensing means for permitting a flow of ambient air to be drawn therethrough into said negative pressure interior region of said housing during fan operation, sensing the magnitude of said flow of ambient air, and precluding operation of said appliance when said magnitude falls below a predetermined level, and temperature sensing means for sensing the temperature within said housing and essentially precluding the flow of ambient air through said pressure sensing means in response to a sensed temperature exceeding a predetermined temperature.

5. The heating appliance of claim 4 wherein said heating appliance is a water heater.

6. The heating appliance of claim 4 wherein:

said temperature sensing means are connected in series with said pressure sensing means in a manner permitting said flow of ambient air to be drawn sequentially through said pressure sensing means and said temperature sensing means into said negative pressure interior region of said fan housing during operation of said draft inducer fan, and said temperature sensing means are operative to block said flow of ambient air therethrough in response to a senses temperature exceeding said predetermined temperature.

7. The heating appliance of claim 6 wherein said temperature sensing means include:

a sensor housing through which said flow of ambient air may pass, and a snap-action temperature sensitive bimetallic disc supported in said sensor housing for thermally created nutation in opposite direction relative thereto.

8. The heating appliance of claim 7 wherein said pressure sensing means include:

a vacuum pressure switch having an air outlet and means for communicating said air outlet with the interior of said sensor housing.

9. The heating appliance of claim 8 wherein:

said means for communicating comprise a conduit connected at one end to said air outlet, and at the other end to said sensor housing.

10. A forced draft, fuel-fired heating appliance comprising:

heating means operative to generate hot combustion gas during use of said appliance;

vent hood means for receiving said hot combustion gas and having an inlet for receiving ambient dilution air for mixture with and cooling of the received hot combustion gas;

draft inducer fan means associated with said vent hood means and operative to withdraw and then discharge into a vent pipe connected to the fan means outlet combustion gas and ambient dilution air from said vent hood means, said draft hood means, during operation thereof, having a negative pressure interior region; and control means for sensing an obstruction in either the vent pipe or said vent hood means inlet during operation of the appliance and responsively shutting down the appliance, said control means including:

pressure sensing means for permitting a flow of ambient air to be drawn therethrough into said negative pressure interior region of said draft inducer fan means during operation thereof, sensing the magnitude of said flow of ambient air, and precluding operation of the appliance when said magnitude falls below a predetermined level, and temperature sensing means for sensing the temperature within said draft inducer fan means and essentially precluding the flow of ambient air through said pressure sensing means in response to a sensed temperature exceeding a predetermined temperature.

11. The heating appliance of claim 10 wherein said heating appliance is a water heater.

12. The heating appliance of claim 10 wherein:

said temperature sensing means are connected in series with said pressure sensing means in a manner permitting said flow of ambient air to be drawn sequentially through said pressure sensing means and said temperature sensing means into said negative pressure interior region of said draft inducer fan means, and said temperature sensing means are operative to block said flow of air therethrough in response to a sensed temperature exceeding said predetermined temperature.

13. The heating appliance of claim 12 wherein said temperature sensing means include:

a sensor housing through which said flow of ambient air may pass, and a snap-action, temperature sensitive bimetallic disc supported in said sensor housing for thermally created nutation in opposite directions relative thereto.

14. The heating appliance of claim 13 wherein said pressure sensing means include:

a vacuum pressure switch having an air outlet, and means for defining a flow passage communicating the interior of said sensor housing with said air outlet.

15. The heating appliance of claim 14 further comprising:

a relatively small vacuum relief opening extending into said flow passage and operative to permit a flow of ambient air into said flow passage to dissipate a vacuum therein occurring when air flow through said sensor housing is blocked in response to a sensed temperature exceeding said predetermined temperature.

16. The heating appliance of claim 12 wherein:

said pressure sensing means are disposed externally of said draft inducer fan means, and said control means include means for mounting said temperature sensing means within said draft inducer fan means.

* * * * *

UNITED STATES PATENT AND TRADEMARK OFFICE

CERTIFICATE OF CORRECTION

PATENT NO. : 5,158,446

DATED : October 27, 1992

INVENTOR(S) : Jacob H. Hall

It is certified that error appears in the above-identified patent and that said Letters Patent is hereby corrected as shown below:

Column 1, line 40, "s" should be --so--.

Column 7, line 20, "4" should be --44--.

Signed and Sealed this

Twenty-ninth Day of March, 1994

*Attest:*

*Attesting Officer*

BRUCE LEHMAN

*Commissioner of Patents and Trademarks*